United States Patent [19]

Futerman

[11] 4,362,199

[45] Dec. 7, 1982

[54] FLEXIBLE CONTAINERS

[75] Inventor: Charles S. Futerman, London, England

[73] Assignee: Miller Weblift Limited, London, England

[21] Appl. No.: 87,507

[22] Filed: Oct. 23, 1979

Related U.S. Application Data

[63] Continuation-in-part of Ser. No. 864,850, Dec. 27, 1977, abandoned.

[30] Foreign Application Priority Data

Jan. 10, 1977 [GB] United Kingdom ..... 795/77

[51] Int. Cl.[3] ..... B65D 33/06

[52] U.S. Cl. ..... 150/12

[58] Field of Search ..... 150/1, 12, 1.7

[56] References Cited

U.S. PATENT DOCUMENTS 1,335,607 3/1920 Salisbury ..... 150/1

1,572,605 2/1926 Howe ..... 150/1

FOREIGN PATENT DOCUMENTS 204052 11/1908 Fed. Rep. of Germany ..... 150/12

*Primary Examiner*—Stephen P. Garbe

*Attorney, Agent, or Firm*—Laubscher, Philpitt & Laubscher

[57] ABSTRACT

An improved flexible container structure is disclosed in which there is woven in selected areas of a base fabric formed of body yarns threads of reinforcing yarns extending in the intended load-bearing direction. Preferably, the tension of the reinforcing yarns during weaving is greater than the tension of the body yarns in the load-bearing direction.

17 Claims, 13 Drawing Figures

WARP THREADS

WEFT THREADS

REINFORCEMENT THREADS

FLEXIBLE CONTAINERS

This application is a continuation-in-part of application Ser. No. 864,850, filed Dec. 27, 1977, now abandoned.

This invention relates to containers for the transport of materials and more particularly to flexible bags for the transportation of particulate material in bulk such as powders, pellets, granules, flakes, etc.

In recent years, there has been an increasing use of bulk containers made of fabric material which is sewn to a suitable shape and provided with lifting loops which can be engaged over the hook of a crane or the forks of a fork lift truck or a similar vehicle. The containers are intended to contain a substantial quantity of material, for example in the range of one half of a ton to two ton. A problem that arises in the construction of such a container, known in the art as an Intermediate Bulk Container (IBC), is that of providing adequate strength because the containers may be roughly handled and/or mishandled and subjected to impulsive forces by the crane or fork lift truck during lifting and transportation.

A common failure is at the point of attachment of the lifting loops to the main area of the fabric of the container. This is doubly undesirable in that, not only does the IBC fail, but the container drops as a whole. It will be appreciated that a container, even a flexible container, containing 1 to 2 tons of material falling from a crane or fork lift truck represents a considerable safety hazard to personnel in the area and at the very least could cause considerable damage to property or equipment in the area. This is likely to be far more costly than the loss of the contents of the container as such. Should an IBC be stressed beyond its design strength, it is highly desirable that the failure should occur in such a manner as to ensure spillage of the contents rather than failure of the lifting means, since the spillage of the particulate material is likely to present far less of a safety hazard.

SUMMARY OF THE INVENTION

It is an object of the present invention therefore to overcome or substantially reduce these disadvantages.

According to one aspect of the invention, there is provided a method of making a flexible bag for the transportation of material, comprising the steps of weaving a base fabric from body yarns, and introducing in selected areas threads of reinforcing yarns during weaving of the base fabric in the intended load-bearing direction, forming the fabric so-formed produced into a bag, and attaching lifting means to the bag at selected areas having the aforementioned reinforcing yarns, the tension of the reinforcing yarns during weaving preferably being greater than the tension of the body yarns in the load-bearing direction.

The tension of the reinforcing yarns is preferably controlled to be higher than that of the body yarns. This may be achieved in any desired manner, for example by feeding the reinforcing yarns from a separate beam, beamette or creel; although it is possible to feed the reinforcing yarns from the same warp beam as the body yarns and use separate tensioning devices for the reinforcing yarns.

According to another aspect of the invention, there is provided a flexible bag for the transportation of material comprising a tubular body of textile material, the, some or each side wall of which has at least one area with additional reinforcing yarns interwoven with the yarns of the body material to provide a reinforced area, lifting means being attached to said reinforced areas.

The base fabric may be woven in any suitable weave, e.g. twill, basket, ribbed or plain, but is preferably plain weave. The body yarns may likewise be any suitable textile yarns, natural or synthetic, staple or filament; but for reasons of economy will usually be of the cheapest type capable of forming a satisfactory bag and in practice will virtually always be polyolefin tape yarns, preferably polypropylene tape yarns, produced by slitting films or sheets of polyolefin material.

The additional reinforcing yarns may be defined as yarns or threads which are:

i. of a different count to the body yarns; and/or ii. of a different tensile strength than the body yarns; and/or iii. of a different material than the body yarn.

The additional ends of reinforcing yarn introduced into selected areas of the base fabric during weaving should preferably be stronger yarns than the body yarns, i.e. be of higher count and/or of higher tensile strength and generally will be of a different material than the body yarns. Thus for a normal polyolefin tape yarn base fabric, the reinforcing yarns could be polyester, polyamide or the like material. The reinforcing yarns will be continuous filament yarns and are likely to be multifilaments. The tensile strength of the reinforcing yarn should preferably be not less than 6.5 g/denier, ideally around 8 g/denier, and tire cord type yarn has been found satisfactory.

While the reinforcing yarns are additional in the sense of being in addition to the body yarns, they need not necessarily be superimposed over body yarns, but may replace some or all of the body yarns in the reinforced area.

Further, according to the preferred method of the invention, the reinforcing yarns are introduced into the base fabrics under higher tension. In practice this means that reinforcing yarns are likely to be fed from a beam, beamettes or a creel separate from the body yarn supply. Weaving the reinforcing yarns under higher tension than the body yarns ensures that, when the fabric is made into an IBC, the reinforcing yarns take up the load through the lifting means before the body yarns become fully stressed. In this connection the use of reinforcing yarns having lower elongation characteristics, is the preferred practice of the invention, to ensure that the bulk of the lifting stress is taken by the reinforcing yarns.

Feeding the reinforcing yarns from a separate source from the body yarn warp beam, allows a greater latitude in the choice of weave pattern of the reinforcing yarns with respect to the base fabric weave. For example the base fabric can be a plain weave and the reinforcing yarns woven in a plain weave also; or the base fabric could be a plain weave with the reinforcing yarns woven in a ribbed weave pattern. The latter combination has been found to be exceptionally advantageous, since, it is believed, the rib weave of the reinforcing yarns allows the reinforcing yarns to move somewhat, relative to the base fabric, when the IBC is in use and this assists in procuring that the reinforcing yarns take up the major portion of the lifting stresses.

The tension of the reinforcing yarns can be controlled by means known in the weaving art, and should preferably be in the range of from 10% to 50% greater than that of the body yarns when the shed is open, i.e. at the time of maximum tension.

The bag can be formed in a variety of ways as discussed more fully hereinafter, and the lifting means, e.g. woven webbing straps, can be attached, preferably by stitching, to one or more selected reinforced areas.

The reinforced areas in the fabric are conveniently as wide or slightly wider than the proposed lifting strap which is to be attached, and 4 to 6 cm has been found a useful range.

In the preferred practice of the invention polyolefin body yarns are used preferably in counts of from 1000 to 2200 denier in the warp. To give adequate cover, 10 to 25 ends per inch may be used, values in the upper end of the range being used for finer count yarns and vice versa. The weft yarns may usefully be in the count range 1200 to 2200 denier using 10 to 20 picks per inch. The reinforcing yarns can usefully be in the count range 1000 to 2500 denier. The bag can have 80,000 to 200,000 denier of reinforcing yarns across the width of the reinforced area, and so the number of reinforcing yarns needed can be calculated from the yarn count and width of the area selected.

Conveniently the bag is formed by connecting together the ends of a single length of material to form a side seam of the bag but a seamless sleeve or separate lengths or material can be used depending on the required shape of the bag. The bag can be formed by folding a first length of material to provide two side panels and a bottom panel, two separate additional side panels being secured to the first length of the material for instance by stitching, to provide the remaining two side panels of a four sided bag.

The reinforced areas of the bag extend without interruption between the top and bottom of the bag, and in some cases across the bottom of the bag.

Conveniently, the bags are made from a continuous length of material having a plurality of spaced bands of reinforced areas parallel to the length thereof. Cut lengths of this material are folded about lines parallel to the length and joined to form a bag. The reinforcement lines may extend along the whole of the continuous length of material but be spaced from each other across the width thereof. In another method, however, the lines of reinforcement may extend across the full width of the material and be spaced from each other along the length of the material.

Most fabrics already have selvedge to prevent ravelling. The selvedges are usually narrow, e.g. $\frac{1}{4}$ or $\frac{1}{2}$ inch. The reinforced areas of the invention can be immediately adjacent to the selvedge if desired, or a reinforced area of the invention can replace or supplement a conventional selvedge.

Conveniently, in a four sided bag, each side panel thereof is provided with two reinforced areas extending between the top and bottom edges and positioned adjacent the corners of the bag, each corner of the bag having the free ends of a lifting loop attached to the reinforced areas on each side of the bag corner. However, more than two reinforced areas can be provided in each side panel if desired, although lifting loops may not necessarily be attached to all of these. Additionally, both free ends of each lifting loop may be attached to a single reinforced area if desired. Alternatively, only some, for instance, two facing sides of a four sided bag, can be provided with the reinforcement areas to which the lifting loops are attached.

BRIEF DESCRIPTION OF THE DRAWINGS

Features and advantages of the invention will appear from the following description of embodiments thereof, given by way of example only, with reference to the accompanying drawings, in which.

DETAILED DESCRIPTION

Figure 1:
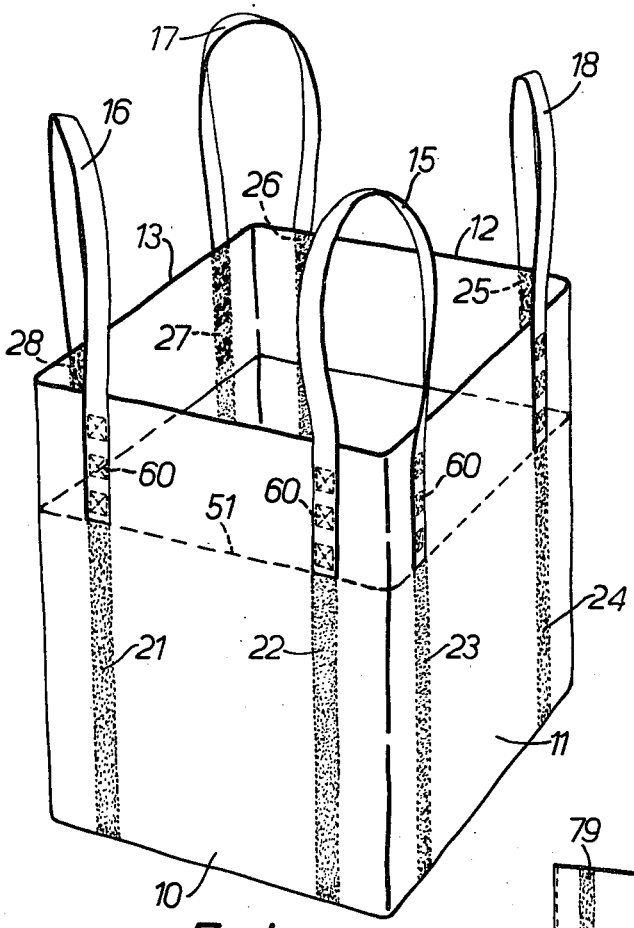
FIG. 1 is a perspective view of an intermediate bulk container.

Referring to the drawings, there is shown in FIG. 1 an intermediate bulk container having four side panels 10, 11, 12 and 13 and a bottom panel (not shown). Each side panel is provided with a pair of reinforced areas in the form of bands 21–28 (the purpose of which will be described in more detail hereafter). The upper edge of the container can be folded over to provide a double thickness of material 51 but this is not essential. Lifting means in the form of loops 15–18 of woven webbing are attached, preferably by stitching 60, to the reinforced areas to provide loops extending from the open upper edges of the container, the loops being stitched through the reinforced areas and the folded-over portion 51 or single layer of material. Any suitable attachment sewing technique can be used, but it is preferred to use the box and cross pattern illustrated in the drawings.

Figure 2:
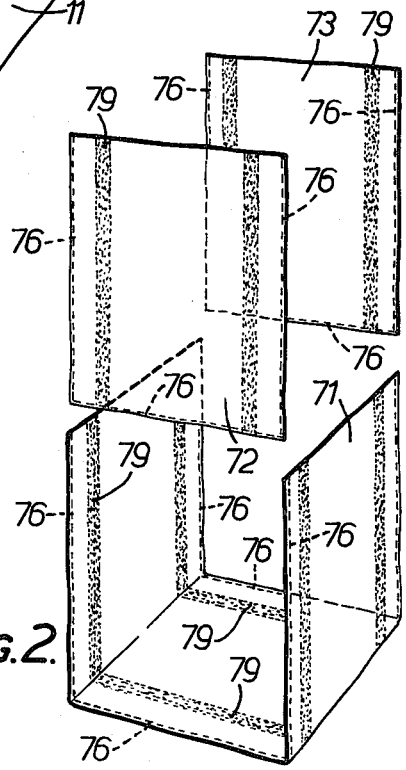
FIG. 2 is a perspective exploded view of an alternative container.

The container can be made up in a variety of ways either from a single seamless cylinder of woven fabric to which a separate bottom or bottom and top is attached or it can be made up from a single length of material formed into a cylinder, the free ends of said length of material being attached together, preferably by stitching, to provide tubular body with a single side seam. As before, a bottom and/or top can then be attached to the tubular body portion. Alternatively, the container can be made up as shown in FIG. 2 with a first single length of fabric 71 providing two of the side panels and the bottom panel of a four sided container, the two side panels 72, 73 being separate lengths of material secured to the edges of the first length of fabric (as indicated by the dotted lined 76) to complete the container. A top can be added if required. In the illustrated embodiment, all the lengths of fabric 71, 72, 73 have reinforced areas 79 but these can be omitted from the side panels 72, 73 depending on the manner of attachment of the loops.

Each side panel, the bottom and top of the container can also be formed individually, the various individual pieces being secured together to form the container.

Although it is preferable to provide each side panel of the container with two spaced reinforced areas 21–28, each side panel can be provided with only one or with more than two reinforced areas. See for instance the alternative embodiments illustrated in FIG. 3.

As illustrated, the reinforced areas extend without interruption between the top and bottom of the container. This is the preferred arrangement as it more effectively transfers the load during lifting over the whole length of each side wall.

Figure 3:
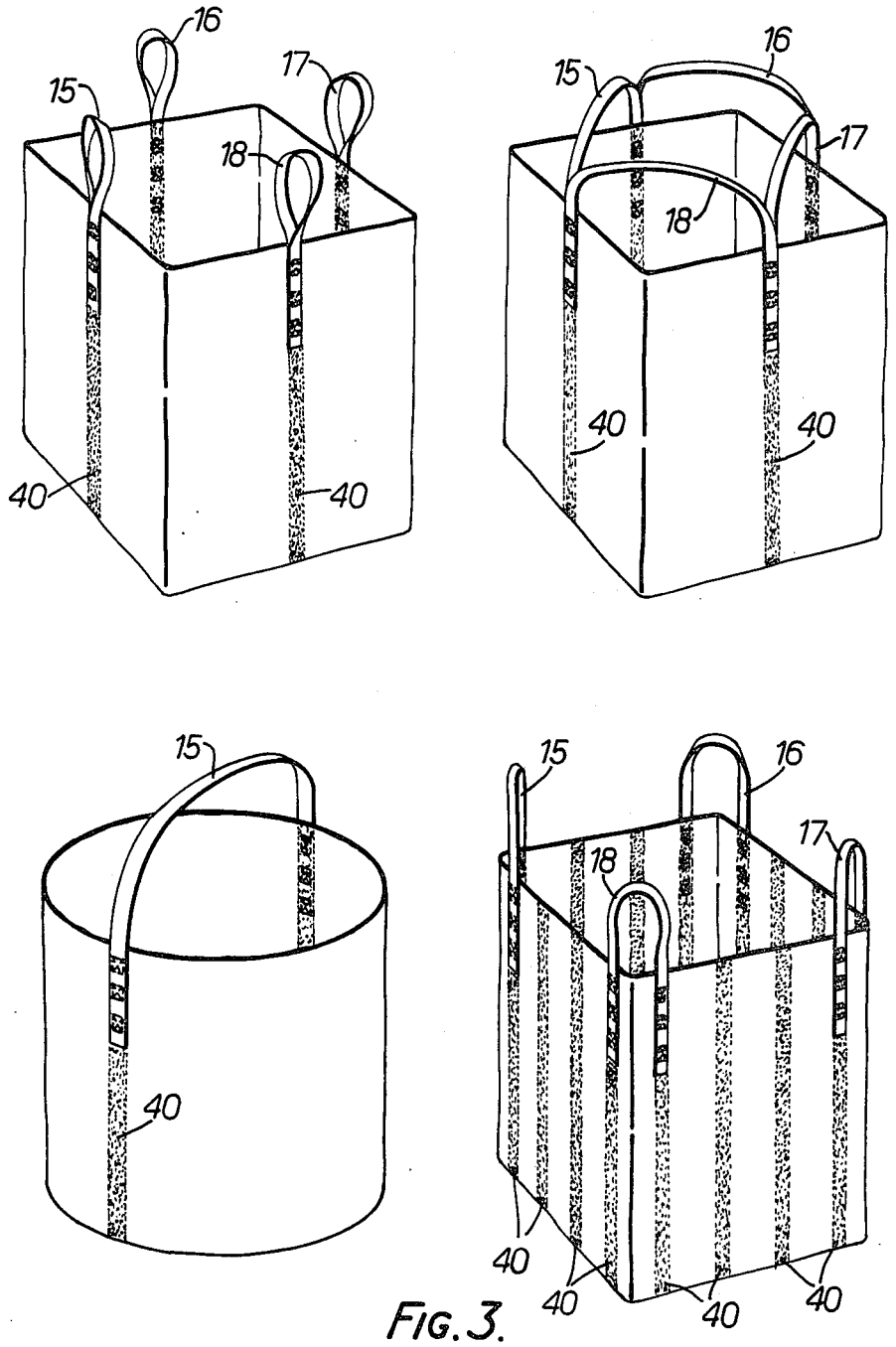
FIG. 3 shows various other alternative containers.

The lifting loops 15–18 are preferably open-ended loops as illustrated, the free ends of each loop being attached to a different reinforcement area 40. However, both free ends could be attached to the same reinforced area if desired as shown in FIG. 3.

The bottom of the container can be either a separate length of fabric (with or without reinforced areas) which is secured to the side panels of the container, or the bottom portion of side panels at the corners of the container may be axially cut to provide separate flaps which may be folded inwardly and secured together. If desired, an outlet spout (not shown) can be provided in the base of the container which can be closed by any suitable means such as tie strings.

Alternatively, the bottom of the container can be formed into a conical configuration by providing a tapered flap at the bottom of each side panel and stitching together adjacent flaps to form a conical base with an outlet opening therein which can be closed with tie strings. If desired an additional covering flap can be stitched to two or more of the bottom edges of the side panels to provide extra security for the bottom of the container, this flap being cut open when the container has to be emptied thereby exposing the folded conical base which is allowed to unfold out of the container body under the weight of the material therein. The tie strings around the outlet in the conical base can then be released to open the outlet and permit the contents of the container to be emptied therefrom.

Figure 8:
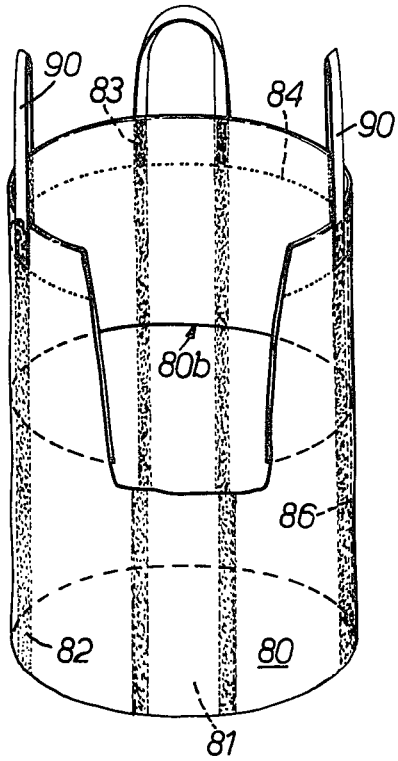
FIGS. 8–10 are perspective views of one form of top for a bulk container.
Figure 9:
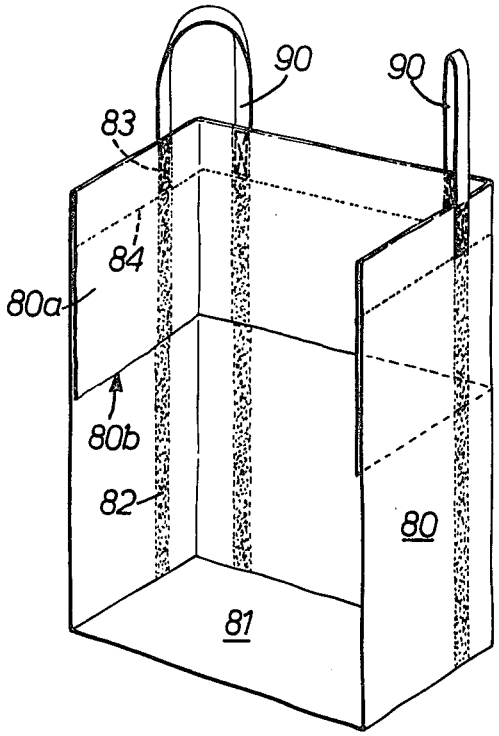
Figure 10:
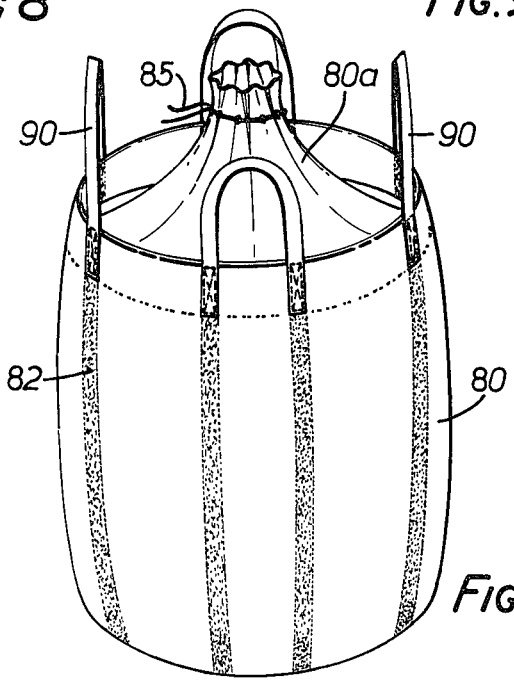

The top of the container can be left open or it can be closed by a separate panel provided with a filling opening or spout. One form of top closure is shown in FIGS. 8–10. The containers shown in FIGS. 8 and 9 each consist of a generally tubular body portion 80 provided with reinforced areas 82. The container is closed at its lower end by a suitable closure 81 and has a side seam 86. The container can have a generally cylindrical or oval cross-section, as in FIG. 8 or 10, or it can be rectangular or square, as shown in FIG. 9.

The top portion 80*a* of the body portion is turned inwardly and handles or handling loops 90 are then sewn, as at 83, to the doubled edge of the folded-in body portion but it is arranged that the handle stitching does not extend below the level indicated by the broken line 84. When the handles have been secured in this way it is possible to pull up the lower edge of the turned-in portion 80*a* of the body portion and, when desired, the container can be filled with the material to be transported, up to approximately the level indicated by line 84. The edge 80*b* of the turned-in portion of the body portion can then be secured together, somewhat in the manner indicated in FIG. 10. To close this edge of the filled container, the turned-in portion of the container near edge 80*b* can be provided with a hem or loops to receive a draw-string 85. In this way, the container is made with the integral closure, simplifying manufacture.

In a bulk container of conventional construction, the regions of greatest stress and therefore the regions at which failure is most likely to occur, are the regions of attachment of the lifting loops to the container body owing to the stresses arising from the transfer of load from one part of the stitched construction to another. In order to increase the strength of the containers described and to substantially reduce this problem, the container body is provided with the reinforced areas 21–28, 40 and 82 to which the lifting loops are attached.

Figure 4:
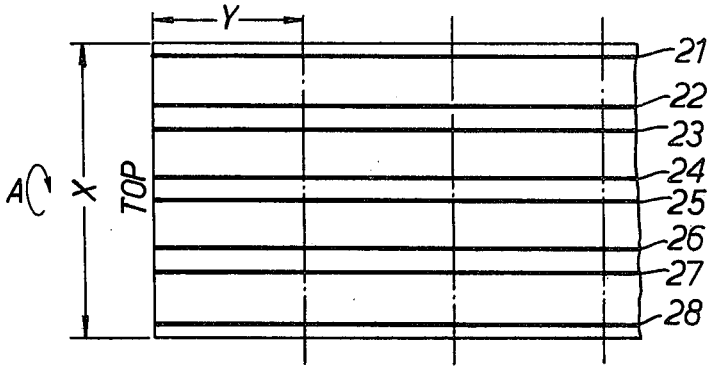
FIG. 4 is a diagrammatic plan view showing a preferred continuous length of material from which the containers of FIGS. 1 to 3 may be made.
Figure 5:
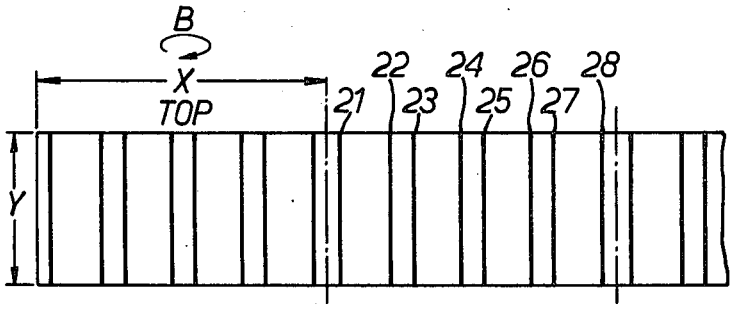
FIG. 5 is a diagrammatic plan view showing an alternative continuous length of material from which the containers of FIGS. 1 to 3 may be made.

Referring now to FIGS. 4 and 5, FIG. 4 shows diagrammatically a continuous length of woven fabric along the length of which reinforced areas (shown in the figure as lines) 21–28 are interwoven, there being eight such areas spaced across the width of the fabric. In order to make a container for instance as shown in FIG. 1, the width X of the fabric is woven so as to correspond to substantially the perimeter size of the container, i.e. the sum total of the width of the 4 sides. Lengths Y of fabric are cut from the continuous length the length Y being equal to or greater that the height of the container depending on whether or not the bottom portion of the container body is to be formed by inwardly folding the sides, and whether or not the top edge is to be folded over. The cut length of fabric is then made up into a tubular container by shaping it about an axis parallel to the lines of reinforcement i.e. in the direction of arrow A.

It will be appreciated that as the reinforced areas extend along the length of the fabric, the reinforcing yarns 37 are interwoven with the weft threads thereof. In FIG. 5 however, the reinforcing threads 37 are interwoven with the warp threads of the fabric to provide a series of spaced reinforced areas extending across the width of the fabric but spaced from each other along the length thereof. The fabric of FIG. 5 is woven so that its width Y corresponds substantially to the height of the container depending on whether or not the bottom portion is to be inwardly folded to provide the container bottom or whether the top edge is to be folded over. Lengths of material X are then cut from the continuous length of fabric, the length X corresponding substantially to the perimeter size of the finished container. The cut length is then made up into the container by shaping it about an axis parallel to the lines of reinforcement in the direction of arrow B.

Figure 6:
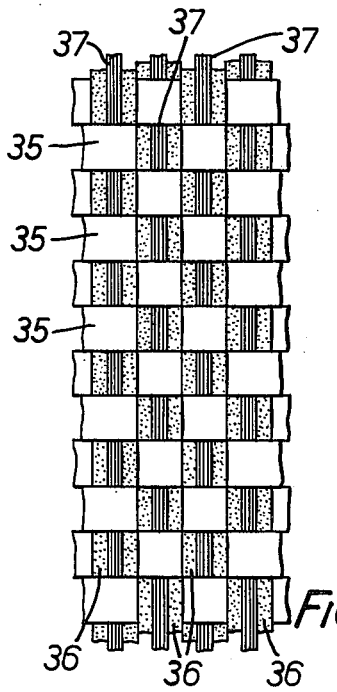
FIG. 6 is a fragmentary view of the material of a fabric weave.
Figure 7:
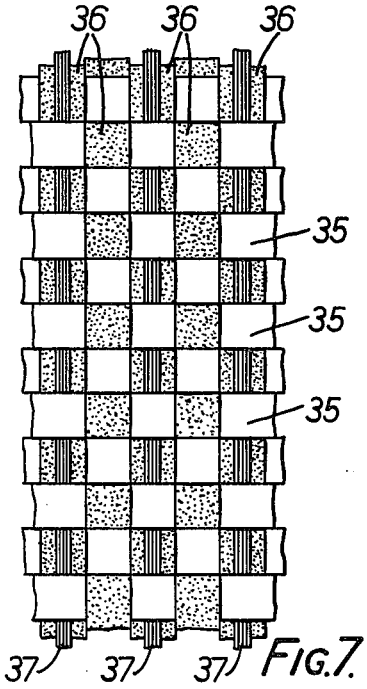
FIG. 7 is a fragmentary view of an alternative fabric weave.

The additional yarns or threads 37 can be interwoven with the threads of the fabric in any suitable pattern. The base fabric itself is usually woven as a plain weave but other weaves such as twill, basket or ribbed can be used. FIG. 6 shows how the reinforcing threads of polyamide or polyester multifilament 37 can be interwoven as a plain weave with a base fabric of polypropylene tapes 35, 36 which is also plain woven. FIG. 7 on the other hand shows the reinforcing threads 37 interwoven as a ribbed weave with a plain woven base fabric. This has been found to be an advantageous arrangement as it allows the reinforcing threads to spread the load during lifting more evenly along the length of the reinforced areas on the container owing to the said threads being able to move to some extent relative to the body yarns more readily than is possible with a plain weave.

Figure 11:
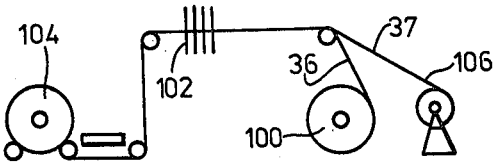
FIG. 11 is a diagrammatic side view of loom showing the feeding of body and reinforcing yarns.
Figure 12:
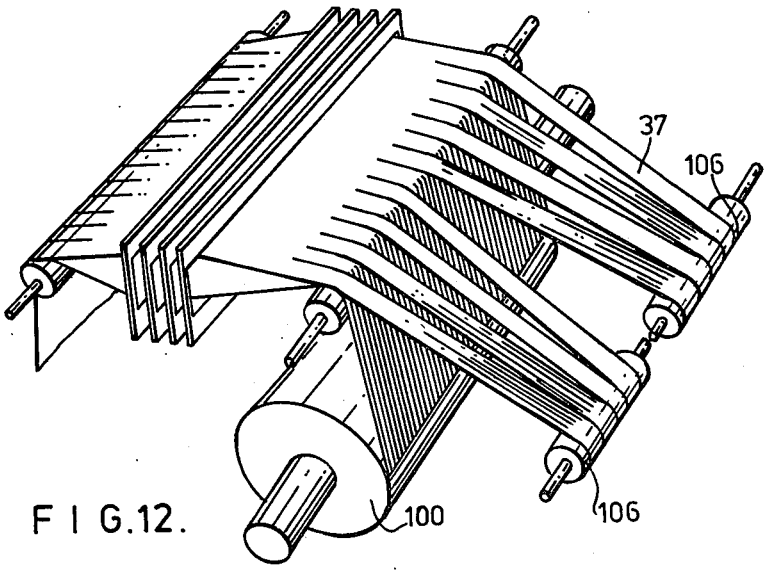
FIG. 12 is a simplified perspective view corresponding to FIG. 11.
Figure 13:
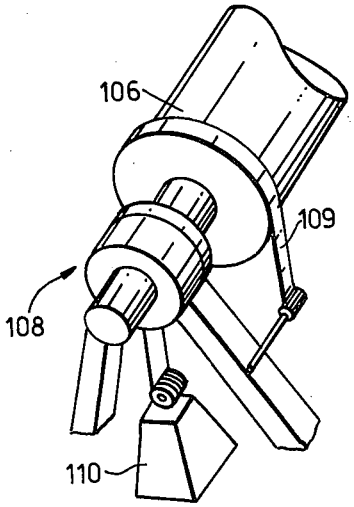
FIG. 13 is a partial perspective view of a reinforcing yarn beam.

Referring now to FIGS. 11 to 13, it can be seen that the polypropylene warp ends 36 are taken from a normal warp beam 100 in the conventional way through the heald shafts represented at 102 and finally out as a woven fabric on to a take-up roller 104. The ends of reinforcing yarn 37 are taken from two beamettes 106 and superimposed over the polypropylene ends 36 in the selected areas (as shown in FIGS. 6 and 7) to appear in the fabric as reinforced areas 21, 22, 40, 79, 82. As can be seen from FIG. 13 the tension of the ends 37 is maintained by a negative tensioning device 108 comprising a band brake 109 carrying a weight 110 of 20–30 lbs. In a typical arrangement the beam 100 carried 18 ends per inch of 1000 denier polypropylene tape 36, and the two beamettes 106 each carried 312 ends of 1680 denier nylon multifilament. Each beamette provided four bands of 78 ends of reinforcing yarns giving eight reinforced areas over the total width of the fabric. Each area was 4.5 cm in width, and the reinforced areas were spaced alternately 37 and 52 cm apart over total fabric width of 361 cm. The tension during open shed on each of the body yarns 36 was 750 gm force, and that on the reinforcing yarns 37 was 1000 gm force.

Preferably, the reinforcing threads 37 are regularly interwoven with the body threads 35, 36 so that they are evenly spaced apart across the width of the reinforced areas. However, the reinforcing threads can be interwoven so that they are closest together in the middle of the strip and become less close towards the edges thereof.

The warp and weft threads of the container base fabric and the reinforcing threads can each be of any suitable natural fibre or yarn of a semi-synthetic or synthetic polymer such as polyester, polyamide, polyolefin or polyacrylic. The fabric may or may not be coated or impregnated after weaving to provide improved insulation, for instance waterproofing.

The lifting loops can be of any suitable material but preferably a woven webbing of a high tensile synthetic textile material e.g. polyester, polyamide or rayon, is used.

The completed container can, if desired, incorporate a tubular liner or a liner specifically shaped to fit the contours of the container.

We have found that the reinforced areas of the invention act by more than simply strengthening the body fabric. The principal occasion of failure of an IBC is at the point where the lifting loop is attached to the body. We have found that the stitching used to attach the lifting loops grips the preferred multifilament reinforcing yarns much better than the polyolefin body yarns and so transfers the load more effectively to the reinforcement yarns and has less tendency to slip. Thus, should failure of an IBC of the invention occur, it will rarely be at the region of attachment of the lifting loop. Merely 'cramming' (i.e. increasing the density, in ends per inch, of the warp threads in certain areas of a fabric-)—as shown in the Japanese Utility Model No. 48-62246 published Aug. 8, 1973—the warp threads to produce a reinforcement will not achieve the desired strengthening and safety effect since the grip of the stitched on lifting loops is not increased, nor are there independently tensioned bands of reinforcing yarns to take the bulk of the stress. The following examples illustrate this better.

EXAMPLES

A base fabric of the present invention was woven comprising 18 ends per inch of 1000 denier polypropylene tape, tenacity 6.15 g/denier, and 13 picks per inch 2000 denier polypropylene. Eight 50 mm wide reinforced areas were producing by superimposing, in each area, 85 ends of 1670 decitex polyester filament as described above in relation to FIGS. 11 to 13. Lengths of this fabric were made into an IBC by folding parallel to the warp and joining at a single side seam to make the body, and sewing on a separate bottom panel. Four webbing straps of 50 mm nylon seat belt webbing (breaking strain 2500 kilos) were attached across each corner to the eight areas using three box and cross sewing patterns, the upper and lower patterns having been sewn twice to give double the stitches. The side seam and base were sewn using nylon thread in a lockstitch pattern. The dimensions were: base 89 cm square, height 120 cm.

For comparison, fabrics were woven—in accordance with the teachings of the aforementioned Japanese Utility Model—from the same body yarns having eight 50 mm bands in which the polypropylene warp ends were crammed to give, respectively, 64 ends and 96 ends in each 50 mm band, i.e. approximately 2× and 3× the warp density. Difficulty was experienced in weaving the latter fabric and it is thought that it would not be possible to weave a fabric in which the warp density was much more than 3× by cramming. The fabrics (referred to hereafter as 'fabric B' and 'fabric A' respectively) were made up as above, and all three IBC's were sent to the UK Department of Industry, National Engineering Laboratory at East Kilbride, Glasgow for testing. The test procedure is given below.

TEST PROCEDURE

The tests, to destruction, were carried out on a 200 KN A Frame and the IBC was carried on a H spreader bar. Prior to the test, the IBC was filled with 1 ton of polymer granules and suspended in the air on the H spreader frame with 1 lifting loop on each part of the H. A flat plate connected to a load cell was placed on top of the polymer inside the bag as the loading device. At the start of the text the H frame was drawn vertically by a hydraulic system causing the plate to apply a load to the IBC. The failure could occur by the loops breaking, the fabric tearing, or the bag simply bursting. On completion of the test the load required to destruct the bag was recorded electronically.

The results obtained were as follows:

TEST NO. MIF.166 (JAPANESE UTILITY MODEL)

Fabric A with 96 ends of 1000 denier polyproplene per band. At a load of 3240 kg the bag failed. Reason for failure: two of the reinforcing bands sheared at the box and cross sewing where the webbing is attached to the IBC.

TEST NO. MIF.167 (JAPANESE UTILITY MODEL)

Fabric B with 64 ends of 1000 denier polypropylene per band. At a load of 2930 kg the bag failed. Reason for failure: two of the reinforcing bands sheared at the box and cross sewing where the webbing was attached to the IBC.

TEST NO. MIF. 174 (present invention)

85 ends of 1670 DTX polyester per band. At a load of 8515 kg the bag failed. Reason for failure: the base seam split.

DISCUSSION OF RESULTS

IBC's are normally designed to handle unit loads between 500 kg and 3000 kg, but the most common requirements for flexible IBC's from woven fabric are between 1 and 2 tons capacity.

The recognized safety factors for IBC's are 5 to 1 for single trip operation, and 6 to 1 for reusable applications. Consequently, for 1 ton safe working load, the minimum break on a destruction test must be not less than 5000 kg and for 2 tons capacity 10000 kg.

From test MIF.174, a standard IBC with polyester reinforcing yarns which broke at 8515 kg. can be rated IBC at 1.6 tons safe working load with no problems, at a safety factor of 5 to 1. Furthermore, this IBC when tested to destruction failed at the base seam, allowing the contents to spread over an area, whilst the bag remains suspended on its lifting loops. This design feature gives an added safety factor: it is more dangerous if the whole load does fall as a unit, particularly to persons working in the area.

This effect is achieved by the correct design of the IBC according to the preferred practice of the invention.

The IBC's tested under MIF.166 and 167 do not meet the required safety factor with a 1 ton load. Both IBC's broke in the same manner on the test to destruction with two of the reinforcing bands shearing at the point of sewing to the webbing. This resulted in both IBC's coming off the rig which in a real life situation could result in a full bag shearing at the lifting loops under severe 'g' loading, e.g. while being lifted on a crane or fork-lift truck.

The reason for the failure at this point was excessive elongation of the polypropylene yarns in the reinforcing bands.

As the load during the test increased, the bands stretched excessively which resulted in the input force changing from a vertical plane to a chevron or diagonal plane. The effect of this resulted in the polypropylene yarns shearing at the sewing point on the bottom box and cross. This in effect means a low realisation of IBC strength in terms of fabric strength.

It is also evident that taking into account the total number of yarns used in the reinforcing bands in relation to the strength recorded on the destruction test the following parameters apply:

| | | |
|---|---|---|
| Test MIF.177 | Polyester Reinforced | 98% |
| Test MIF.166 | Fabric A | 69% |
| Test MIF.167 | Fabric B | 93% |

It is evident from the above factors that fabric A gave a very poor strength realization and this undoubtedly is due to the fact that the yarns were crammed very tight in weaving. This confirms the view after weaving, that 96 ends of 1000 denier per 50 mm band is as far as one can go when using our standard base fabric of 18×13.

What is claimed is:

1. A flexible bag for transporting material, comprising (a) a body of textile fabric material including warp and weft threads, said body including bottom and side wall portions, said side wall portions having upper edges, selected parts of said side wall portions containing reinforcing warp threads which are formed of a synthetic plastic material and are interwoven with weft threads, thereby to provide reinforced areas, all of said reinforcing threads having a higher tensile strength than the warp threads in an area other than said reinforced areas; and (b) open-ended loop lifting means having free ends, said free ends being attached to said reinforced areas at locations which are spaced upwardly from said bag bottom portion and are adjacent the upper side wall edges, respectively, thereby to produce a bag having a greater load bearing capacity when lifted by said lifting means.

2. A flexible bag as claimed in claim 1, wherein the reinforced area extends continuously between the top and bottom of the bag.

3. A flexible bag as claimed in claim 2, wherein the reinforced area extends continuously across the bottom of the bag.

4. A flexible bag as claimed in claim 1, wherein the bag is four-sided.

5. A flexible bag as claimed in claim 1, wherein the bag is cylindrical.

6. A flexible bag as claimed in claim 1, wherein the tubular body of the bag is formed from a single piece of material whose opposite free ends are joined together to form a side seam.

7. A flexible bag as claimed in claim 1, wherein the tubular body of the bag comprises a first length of material which is folded to provide two side panels and the bottom of the bag and two separate additional side panels secured to the side edges of said first length of material.

8. A flexible bag as claimed in claim 1, wherein the material of the body of the bag is woven in a plain weave, the reinforcing threads being interwoven therewith as a ribbed weave running from the top to the bottom of the bag.

9. A flexible bag as claimed in claim 1, wherein the material of the body of the bag is woven in a plain weave, the reinforcing threads being interwoven therewith also as a plain weave.

10. A flexible bag as claimed in claim 1, wherein there are more reinforcing threads in the central region of the reinforced area than at its peripheral region.

11. A flexible bag as claimed in claim 1, wherein at least one of the bag body and reinforcing areas is made from a polyolefin synthetic polymer textile material.

12. A flexible bag as claimed in claim 11, wherein the reinforcing threads consist of a polyamide synthetic polymer textile material.

13. A flexible bag as claimed in claim 11, wherein the reinforcing threads consist of a polyolefin synthetic polymer material having a greater load bearing capacity than the body yarns in the load bearing direction.

14. A flexible bag as claimed in claim 1, wherein the reinforcing threads consist of a polyester synthetic polymer textile material.

15. A flexible bag as claimed in claim 1, wherein the free ends of each loop are attached to the same reinforced area.

16. A flexible bag as claimed in claim 1, wherein the free ends of each loop are attached to separate reinforced areas.

17. A flexible bag as claimed in claim 16, wherein the free ends of each loop are attached to adjacent reinforced areas.

* * * * *